US011357087B2

(12) United States Patent
Chan et al.

(10) Patent No.: US 11,357,087 B2
(45) Date of Patent: Jun. 7, 2022

(54) METHOD FOR DRIVING A PASSIVE MATRIX LED DISPLAY

(71) Applicant: Solomon Systech (Shenzhen) Limited, Shenzhen (CN)

(72) Inventors: Wing Chi Stephen Chan, Hong Kong (HK); Chi Wai Lee, Hong Kong (HK); Pak Kong Dunn, Hong Kong (HK); Tung Hoi Lau, Hong Kong (HK); Chun Hung Lai, Hong Kong (HK)

(73) Assignee: Solomon Systech (Shenzhen) Limited, Shenzhen (CN)

( * ) Notice: Subject to any disclaimer, the term of this patent is extended or adjusted under 35 U.S.C. 154(b) by 97 days.

(21) Appl. No.: 16/920,376

(22) Filed: Jul. 2, 2020

(65) Prior Publication Data

US 2022/0007478 A1 Jan. 6, 2022

(51) Int. Cl.

| | |
|---|---|
| ***H05B 45/325*** | (2020.01) |
| ***G09G 3/20*** | (2006.01) |
| ***G09G 3/32*** | (2016.01) |

(52) U.S. Cl.

CPC ..... *H05B 45/325* (2020.01); *G09G 3/204* (2013.01); *G09G 3/2025* (2013.01); *G09G 3/32* (2013.01); *G09G 2310/0243* (2013.01); *G09G 2310/06* (2013.01); *G09G 2320/0233* (2013.01); *G09G 2320/0247* (2013.01)

(58) Field of Classification Search

CPC ..... G09G 3/2007; G09G 3/2018–2055; G09G 3/2077; G09G 3/2081; G09G 3/32; G09G 3/3216; G09G 3/3275–3291; G09G 3/3622–3644; G09G 3/3685–3696; G09G 2310/0243; G09G 2310/0264; G09G 2310/027–0275; G09G 2310/0289; G09G 2310/06; G09G 2320/02; G09G 2320/0204; G09G 2320/0219; G09G 2320/0223; G09G 2320/0233; G09G 2320/0242–0252; G09G 2320/0271; H05B 45/00; H05B 45/325

See application file for complete search history.

(56) References Cited

U.S. PATENT DOCUMENTS

| | | | | |
|---|---|---|---|---|
| 6,175,355 | B1 * | 1/2001 | Reddy | G09G 3/2018 345/691 |
| 6,184,874 | B1 * | 2/2001 | Smith | G09G 3/22 345/690 |
| 2010/0026722 | A1 * | 2/2010 | Kondo | G09G 3/2007 345/660 |
| 2012/0287178 | A1 * | 11/2012 | Ding | G09G 3/2007 345/690 |

FOREIGN PATENT DOCUMENTS

| | | | | |
|---|---|---|---|---|
| WO | WO-0245016 | A2 * | 6/2002 | G09G 3/3406 |

* cited by examiner

*Primary Examiner* — Nathan Danielsen

(74) *Attorney, Agent, or Firm* — Idea Intellectual Limited; Margaret A. Burke; Sam T. Yip

(57) ABSTRACT

A passive matrix LED display driving scheme based on subframe pulse width modulation (PWM) to increase frame scan rate and further with channel-to-channel compensation is provided. The scheme may comprise: dividing each frame of the display video into T number of subframes; converting a driving signal for a pixel into a N-bit driving data, compensating the driving data with a compensation value; mapping the compensated driving data into the T number of subframes respectively.

20 Claims, 14 Drawing Sheets

Digital Driving Data

| b[15:12] | b[11:8] | b[7:4] | b[3:0] |
|---|---|---|---|
| 0001 | 1000 | 0010 | 1010 |

Primary Driving data

Middle Driving data

Auxiliary Driving data

Subframes

| Cycle | b[15:12] | b[11:8] | b[7:4] | b[3:0] |
|---|---|---|---|---|
| 0 | 0001 | 1000 | 0 | 1010 |
| 1 | 0001 | 1000 | 0 | NA |
| 2 | 0001 | 1000 | 0 | NA |
| 3 | 0001 | 1000 | 1 | NA |
| 4 | 0001 | 1000 | 0 | NA |
| 5 | 0001 | 1000 | 0 | NA |
| 6 | 0001 | 1000 | 0 | NA |
| 7 | 0001 | 1000 | 0 | NA |
| 8 | 0001 | 1000 | 0 | NA |
| 9 | 0001 | 1000 | 0 | NA |
| 10 | 0001 | 1000 | 0 | NA |
| 11 | 0001 | 1000 | 1 | NA |
| 12 | 0001 | 1000 | 0 | NA |
| 13 | 0001 | 1000 | 0 | NA |
| 14 | 0001 | 1000 | 0 | NA |
| 15 | 0001 | 1000 | 0 | NA |

FIG. 6

| b[15:12] | b[11:8] | b[7:4] | b[3:0] |
|---|---|---|---|
| 0001 | 1000 | 0010 | 0110 |
| 0000 | 0001 | 0010 | 0101 |
| 0001 | 0010 | 0101 | NA |
| 0010 | 1010 | 0111 | 0110 |

Compensated Driving Data

| b[15:12] | b[11:8] | b[7:4] | b[3:0] |
|---|---|---|---|
| 0010 | 1010 | 0111 | 0110 |

Primary Driving data

Middle Driving data

Auxiliary Driving data

Subframes

| Cycle | b[15:12] | b[11:8] | b[7:4] | b[3:0] |
|---|---|---|---|---|
| 0 | 0010 | 1010 | 0 | 0110 |
| 1 | 0010 | 1010 | 1 | NA |
| 2 | 0010 | 1010 | 0 | NA |
| 3 | 0010 | 1010 | 1 | NA |
| 4 | 0010 | 1010 | 0 | NA |
| 5 | 0010 | 1010 | 1 | NA |
| 6 | 0010 | 1010 | 0 | NA |
| 7 | 0010 | 1010 | 1 | NA |
| 8 | 0010 | 1010 | 0 | NA |
| 9 | 0010 | 1010 | 1 | NA |
| 10 | 0010 | 1010 | 0 | NA |
| 11 | 0010 | 1010 | 1 | NA |
| 12 | 0010 | 1010 | 0 | NA |
| 13 | 0010 | 1010 | 1 | NA |
| 14 | 0010 | 1010 | 0 | NA |
| 15 | 0010 | 1010 | 0 | NA |

FIG. 9

METHOD FOR DRIVING A PASSIVE MATRIX LED DISPLAY

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

The present invention is generally related to passive matrix LED displays. More particularly, the present invention is related to display driving schemes based on subframe pulse width modulation (PWM) and further with channel-to-channel compensation.

BACKGROUND

There are always desires for small, low-energy devices with LED displays offering high dynamic range and high response speed. For example, a user may want to play video games on a smartphone with high contrast and no motion blur under both dark and bright ambient lighting conditions, which requires a mini-display with high response speed and high dynamic range at both dark and bright background illuminance levels. However, response speed and dynamic range are two conflicting performance parameters of driving LED displays. In designing a driving scheme for a particular display panel, an increase of dynamic range is always associated with a reduced speed of response, and vice versa.

FIG. 1 depicts a basic structure of a typical passive matrix LED display panel. The passive matrix LED display panel may have a three-layer configuration comprising a source electrode layer comprising a plurality of source electrodes arranged in parallel, a common electrode layer comprising a plurality of common electrodes arranged in parallel and being perpendicular to the source electrodes; and an electroluminescent layer sandwiched between the source electrode layer and common electrode layer. The electroluminescent layer may comprise a matrix of electroluminescent elements, such as microscopic LED (mini-LED or micro LED) and organic LED, each corresponding to a pixel of the display.

Typically, a pixel of a display panel turns on when the voltage across its corresponding electroluminescent element is greater than a threshold voltage, and then its brightness is related to the amount of current passing through the corresponding electroluminescent element. FIG. 2 depicts a timing diagram of driving signals for driving an electroluminescent element corresponding to a selected pixel over a scan line period in accordance to a typical pulse width modulation (PWM) driving scheme. In the beginning of the line scan period, a corresponding electroluminescent element of a selected pixel is pre-charged to a predefined voltage, which is just below its threshold voltage Vt via a corresponding source electrode at a voltage-drive stage (also referred to the pre-charge stage). Thereafter, a current is driven on to the corresponding source electrode to turn on the pixel in a current-drive stage. The voltage applied to the electroluminescent element has reached its threshold voltage Vt and the electroluminescent element has been turned on.

The state and brightness of the pixel is then directly dependent on the duty cycle and current amplitude of the PWM driving waveform.

At the beginning of the current drive stage, there is an uncontrollable duration in which the voltage applied to the electroluminescent element has not reached its threshold voltage Vt and the electroluminescent element has not been turned on. The length of uncontrollable duration for an electroluminescent element is related to the combined capacitance between the driving circuit to the electroluminescent element, which is the combination of capacitances of all electroluminescent elements along the source line connected to the electroluminescent element, plus the parasitic capacitance of the source electrode connected to the source line. Since different electroluminescent elements may have different capacitances, the combined capacitance of each source line may be different from each other.

Therefore, electroluminescent elements at different data signal lines (or channels) will have different lengths of uncontrollable durations. For example, as shown in FIG. 3, even if pixels S1C1 and S2C1 have the same signal values, the PWM driving waveform P1 for pixel S1C1 may have a shorter uncontrollable duration than that of the PWM driving waveform P2 for pixel S2C1. As a result, the intensity of pixel S1C1 will be higher than the intensity of S2C1. Display illumination uniformity problem is then caused by such intensity difference. It would therefore be desirable to have a channel-to-channel compensation scheme to address such problem. As shown in FIG. 4, if the original driving signal waveforms P1 and P2 for the two pixels S1C1 and S2C1 can be compensated with different compensations such that the two pixels are driven by the compensated driving signal waveforms P'1 and P'2 respectively, illumination uniformity can be restored.

SUMMARY OF THE INVENTION

One objective of the present invention is to provide a driving method that allows high refresh rate for reducing flickering and motion blur and high dynamic range to increase the contrast between the darkest and brightest regions in passive matrix display without the needs of a high-speed system clock. Another objective of the present invention is to provide a compensation scheme for solving the aforesaid display uniformity problem.

According to one aspect of the present invention, a method based on subframe pulse width modulation (PWM) for driving a passive matrix display is provided. The method comprises: dividing each frame of the display video into T number of subframes, wherein the PMW driving waveform at each subframe comprises a primary waveform, a middle waveform and an auxiliary waveform; converting an original driving signal for a pixel to a N-bit digital driving data; and mapping the N-bit digital driving data into the T number of subframes. The mapping of the N-bit digital driving data into the T number of subframes comprises: extracting R number of the rightmost digits of the digital driving data to form a R-bit auxiliary driving data and applying the auxiliary driving data into an auxiliary waveform of only one of the T number of subframes; extracting M number of middle digits of the digital driving data, wherein M is given by $M=\log_2 T$ and the M number of middle digits are adjacent to the R number of rightmost digits, and transforming the M number of the middle digits into a T-bit middle driving data and applying each digit of the middle driving data to middle waveforms of corresponding subframes respectively; extracting L number of the leftmost digits of the digital driving data to form a L-bit primary driving data, where L=N−M−R, and applying the primary driving data to primary waveforms of all of the T number of subframes.

According to another aspect of the present invention, a method based on subframe pulse width modulation (PWM) with channel-to-channel compensation for driving a passive matrix display is provided. The method comprises: dividing each frame of the display video into T number of subframes, wherein the PMW driving waveform at each subframe comprises a primary waveform, a middle waveform and an auxiliary waveform; converting and compensating an original driving signal for a pixel according to a compensation value to form a N-bit compensated driving data; and mapping the N-bit compensated driving data into the T number of subframes. The conversion and compensation of the original driving signal for a pixel comprises: converting the original driving signal to a N-bit digital original data; converting the compensation value to a N-bit digital compensation data; multiplying the digital compensation data by T; and combining the digital original data and the multiplied digital compensation data to form the N-bit compensated driving data. The mapping of the compensated driving signal into the T number of subframes is similar to previous embodiment.

BRIEF DESCRIPTION OF THE DRAWINGS

Embodiments of the invention are described in more details hereinafter with reference to the drawings, in which:

FIG. 6 depicts a mapping computation table for an exemplary mapping process in accordance with an embodiment of the present invention;

FIG. 9 depicts a mapping computation table for an exemplary mapping process in accordance with an embodiment of the present invention;

DETAILED DESCRIPTION OF THE INVENTION

In the following description, methods for driving a passive matrix display and the like are set forth as preferred examples. It will be apparent to those skilled in the art that modifications, including additions and/or substitutions may be made without departing from the scope and spirit of the invention. Specific details may be omitted so as not to obscure the invention; however, the disclosure is written to enable one skilled in the art to practice the teachings herein without undue experimentation.

In accordance with one embodiment of the present invention, a method based on pulse width modulation (PWM) for driving a passive matrix display is provided. The method may comprise a subframe modulation process in which each frame of the display video is divided into T number of subframes. The PMW driving waveform at each subframe comprises a primary waveform, a middle waveform and an auxiliary waveform. Each pixel is then driven by T number of subframe driving waveforms within each frame at a subframe rate which is T times of the original frame rate. For a display based on an original PWM operated at a N-bit resolution, the subframe PWM in each subframe will then be generally operated at a N'-bit resolution, where $N'=(N-\log_2 T)$.

Figure 1:
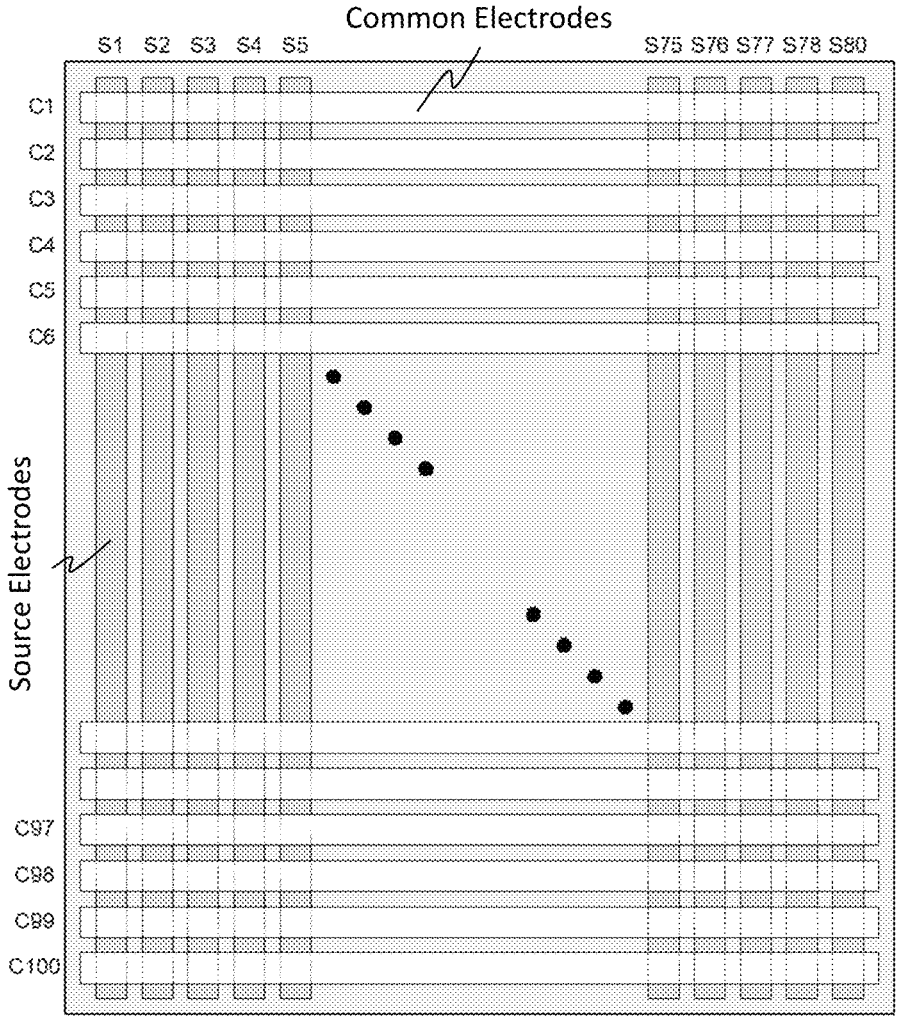
FIG. 1 (Related Art)
FIG. 1 depicts a three-layer basic structure of a typical passive matrix display panel.
Figure 2:
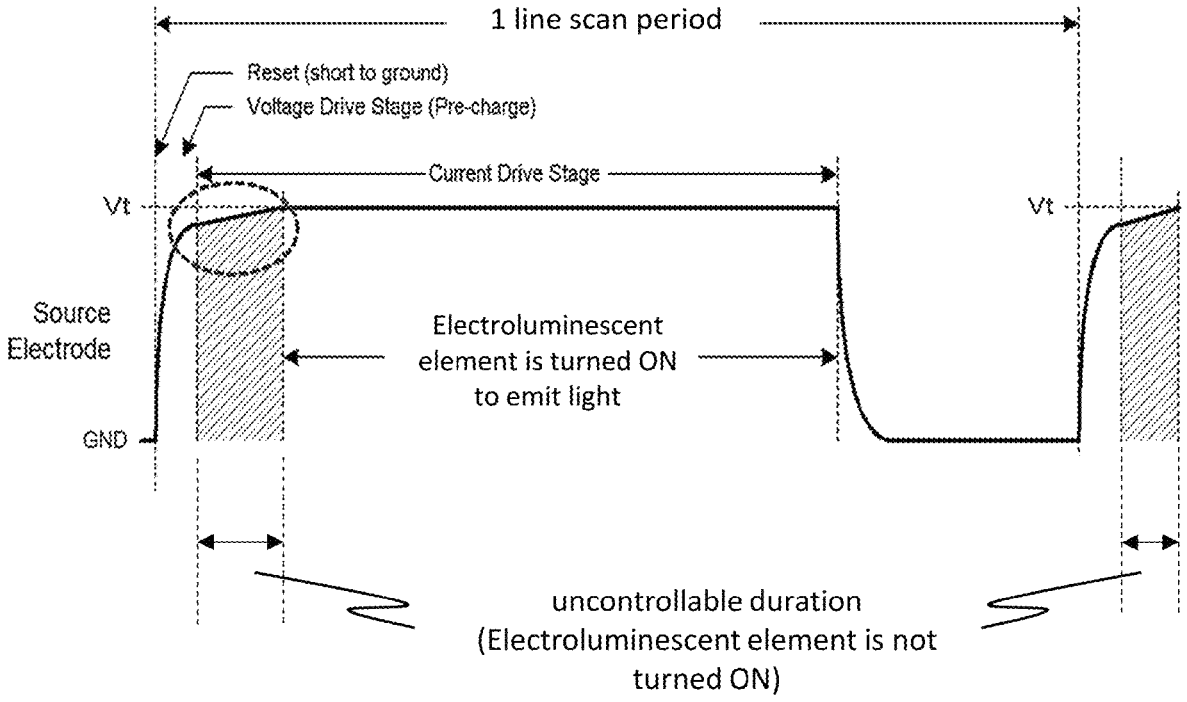
FIG. 2 (Related Art)
FIG. 2 depicts a timing diagram of driving signals in accordance to a typical pulse width modulation (PWM) driving scheme.
Figure 3:
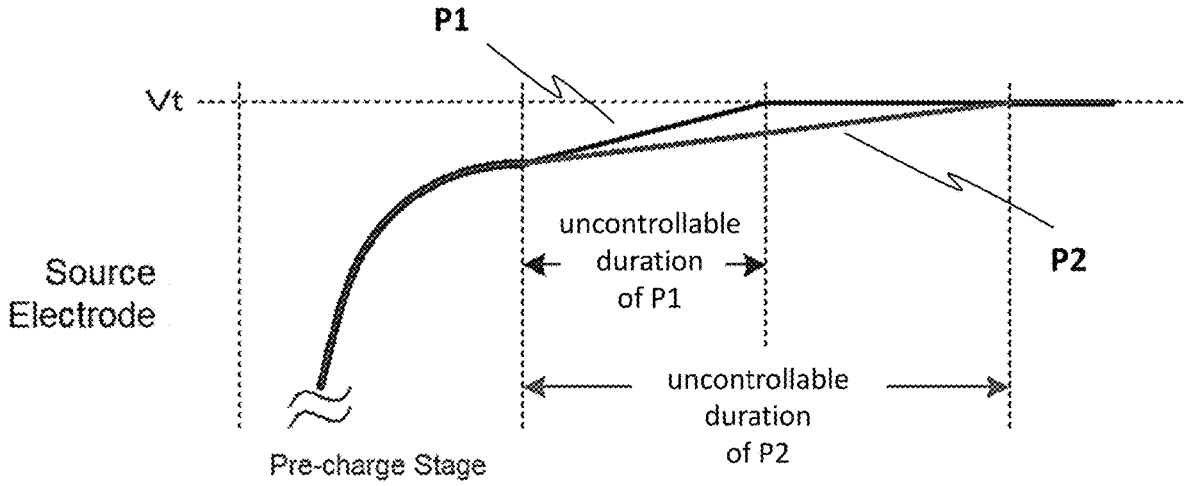
FIG. 3 (Related Art)
FIG. 3 depicts timing diagrams of two different driving signal waveforms for two pixels at two different data signal lines which have the same signal values.
Figure 3:
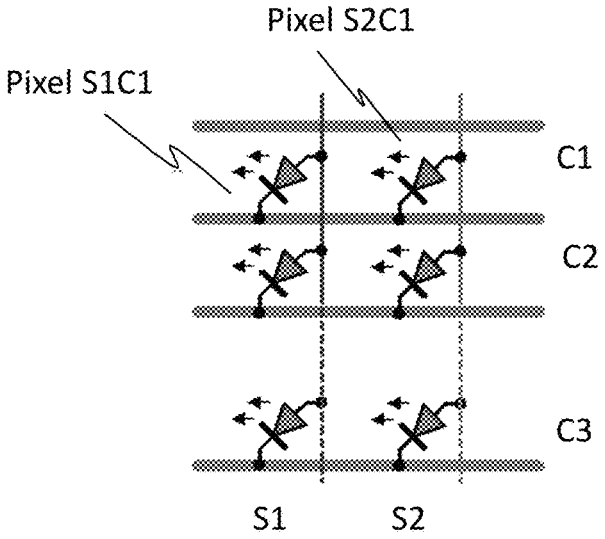
FIG. 3 (Related Art)
Figure 4:
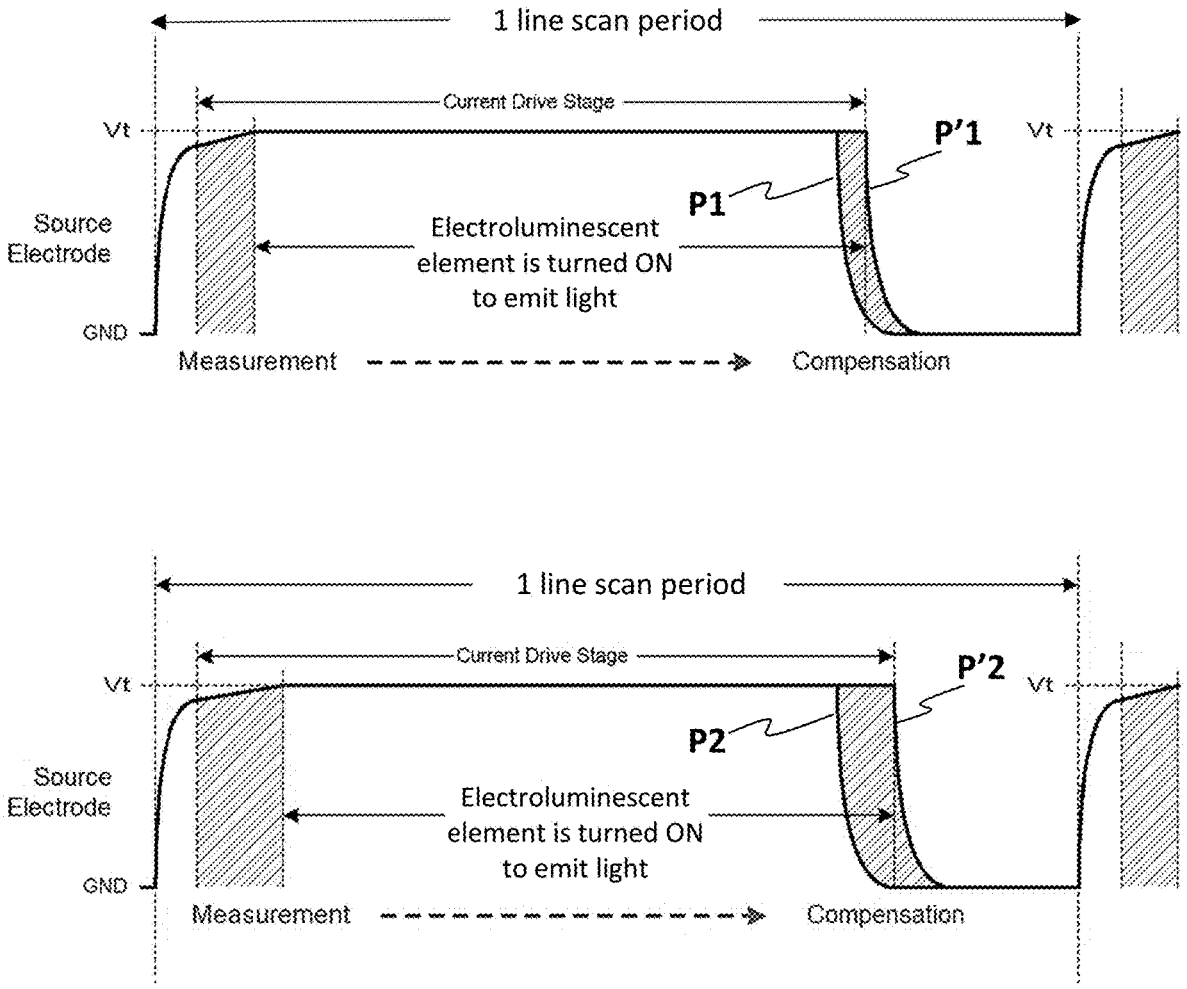
FIG. 4 (Related Art)
FIG. 4 depicts timing diagrams of original and compensated driving signal waveforms corresponding to the two different pixels of FIG. 3.
Figure 5:
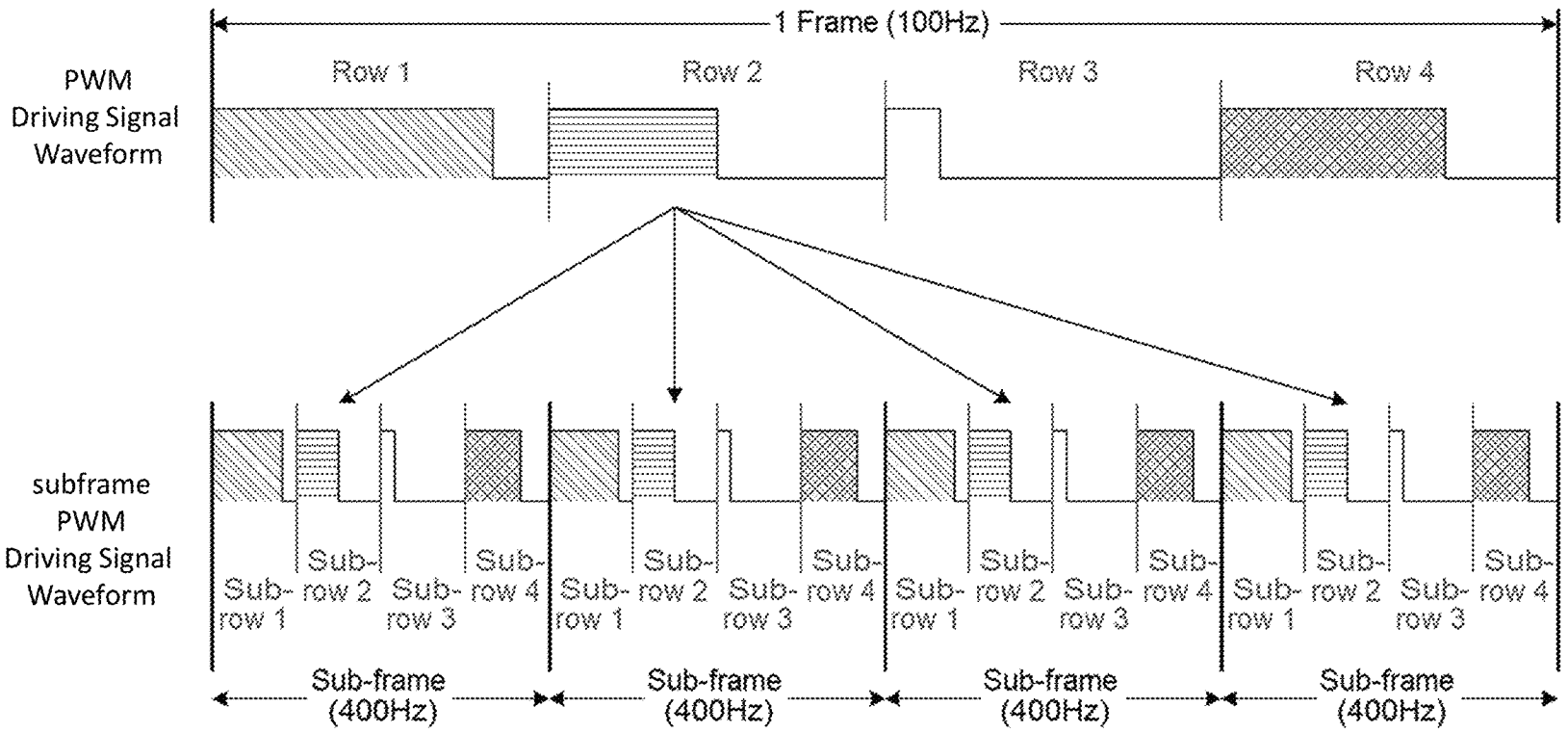
FIG. 5 depicts respectively timing diagrams of PWM driving signal waveforms and their corresponding subframe PWM driving signal waveforms for an exemplary subframe modulation process in accordance with an embodiment of the present invention.

FIG. 5 depicts timing diagrams of PWM driving signal waveforms and their corresponding subframe PWM driving signal waveforms respectively for an exemplary subframe modulation process in accordance with an embodiment of the present invention. For simplicity, the passive matrix display panel is assumed to have 4 rows of pixels. In this exemplary subframe modulation process, the passive matrix display panel has an original frame rate of 100 Hz and each frame is divided into 4 subframes. The original PWM driving signal waveform for a pixel at Row r (r=1, 2, 3 and 4) is divided into 4 subframe PWM driving signal waveforms (Sub-row s, where s=1, 2, 3, 4), which are activated in the 4 subframes respectively. Each pixel is then driven by 4 subframe driving signal waveforms within the frame at a subframe rate of 400 Hz, which is 4 times of the original frame rate of 100 Hz.

If the original PWM driving signal waveform has an 8-bit resolution (or counts between 0 to 255), then the subframe PWM driving signal waveform in each subframe will have a 6-bit+1 resolution (or counts between 0 to 64). If the resolution of the original PWM driving signal waveform on a particular row is 210 counts then the resolutions of the subframe PWM driving signal waveforms in the four subframes should have 52, 53, 52 and 53 counts respectively.

Alternatively, each frame may be divided into 16 subframes such that the PWM driving signal for each pixel will be divided into 16 subframe PWM driving signals which are activated in the 16 subframes respectively. If the original PWM driving signal waveform has a 12-bit resolution (or counts between 0 to 4095), then the subframe PWM driving signal waveform in each subframe will have a 8-bit+1 resolution (or counts between 0 to 255). If the resolution of the original PWM driving signal waveform on a particular row is 1,354 counts, the resolutions of the subframe PWM signal waveform in the 16 sub-frames should have 85, 84, 85, 85, 85, 84, 85, 84, 85, 84, 85, 85, 85, 84, 85, and 84 counts respectively.

The method may further comprise converting a driving signal to a N-bit digital driving data and mapping the N-bit digital driving data into the T number of subframes to drive the pixel. The mapping of the N-bit digital driving data into the T number of subframes comprises: extracting R number of the rightmost digits of the digital driving data to form a R-bit auxiliary driving data and applying the auxiliary driving data to an auxiliary waveform of only one of the T number of subframes; extracting M number of middle digits of the digital driving data, wherein M is given by $M=\log_2 T$ and the M number of middle digits are adjacent to the R number of rightmost digits, and transforming the M number of the middle digits into a T-bit middle driving data and applying each digit of the middle driving data to middle waveforms of corresponding subframes respectively; extracting L number of the leftmost digits of the digital driving data to form a L-bit primary driving data, where L=N−M−R, and applying the primary driving data to primary waveforms of all of the T number of subframes.

Preferably, the T-bit middle driving data may be obtained by a matrix operation: x'=xA, where x is a 1-by-M matrix with its entries $x_{1i}$ being equal to the $i^{th}$ digit (i=1, 2, . . . M) of the M number of middle digits, of the digital driving data, A is a M-by-T transform matrix with its entries being binary digits, and x' is a 1-by-T matrix with its entries $x'_{1j}$ forming the $j^{th}$ digit of the T-bit middle driving data (j=1, 2, . . . , T).

The transform matrix A may comprise T−1 number of "1" digits. Each column of the transform matrix A may have at most one "1" digit and each row of the transform matrix A may have at least one "1" digits.

Optionally, the $k^{th}$ row of the transform matrix A may have $N/(2^k)$ number of "1" digits, wherein k=1, 2, . . . M.

For a subframe PWM driving arrangement where N=16, T=16 and R=4, the number M is given by $M=\log_2 T=\log_2(16)=4$ and the number L is given by L=N−R−M=16−4−4=8. The digital driving data is mapped to the 16 subframes by: extracting the eight leftmost digits of the digital driving data to form a 8-bit primary driving data and applying the primary driving data to primary waveforms of all of the 16 subframes, extracting the four rightmost digits of the digital driving data to form a 4-bit auxiliary driving data and applying the auxiliary driving data to an auxiliary waveform of only one of the 16 subframes, and transforming the four middle digits of the digital driving data into a 16-bit middle driving data and applying each digit of the middle driving data to middle waveforms of corresponding subframes respectively. The transformation is by performing a matrix operation with a 4-by-16 transform matrix A given by:

$$A=\begin{bmatrix} 1&0&1&0&1&0&1&0&1&0&1&0&1&0&1&0\\ 0&1&0&0&0&1&0&0&0&1&0&0&0&1&0&0\\ 0&0&0&1&0&0&0&0&0&0&0&1&0&0&0&0\\ 0&0&0&0&0&0&0&1&0&0&0&0&0&0&0&0 \end{bmatrix},$$

which has eight "1" in the first row, four "1" in the second row, two "1" in the third row and one "1" in the fourth row.

For a subframe PWM driving arrangement where N=16, T=8 and R=4, the number M is given by $M=\log_2 T=\log_2(8)=3$ and the number L is given by L=N−R−M=16−4−3=9. The digital driving data is mapped to the 8 subframes by: extracting the nine leftmost digits of the digital driving data to form a 9-bit primary driving data and applying the primary driving data to primary waveforms all of the 8 subframes, extracting the four rightmost digits of the digital driving data to form a 4-bit auxiliary driving data and applying the auxiliary driving data to an auxiliary waveform of only one of the 8 subframes, and transforming the three middle digits of the digital driving data into a 8-bit middle driving data and applying each digit of the middle driving data to middle waveforms of corresponding subframes respectively. The transformation is by performing a matrix operation with a 3-by-8 transform matrix A given by:

$$A=\begin{bmatrix} 1&0&1&0&1&0&1&0\\ 0&1&0&0&0&1&0&0\\ 0&0&0&1&0&0&0&0 \end{bmatrix},$$

which has four "1" in the first row, two "1" in the second row and one "1" in the third row.

FIG. 6 shows a mapping computation table for an exemplary mapping process for a subframe PWM driving arrangement where N=16, T=16 and R=4. In the exemplary mapping process as shown in FIG. 6, a 16-bit digital driving data (0001 1000 0010 1010) is mapped by: extracting the eight leftmost digits (i.e. b [15:8]) of the digital driving data to form an 8-bit primary driving data and applying the primary driving data (0001 1000) to all of the subframes (i.e. at cycle=0, 1, . . . 15), extracting the four rightmost digits (i.e. b[3:0]) of the digital driving data to form a 4-bit auxiliary driving data (1010) and applying the auxiliary driving data into the first frame (i.e. at cycle=0) only as an example, transforming the four middle digits (i.e. b[7:4]) of the digital driving data into a 16-bit middle driving data (0001 0000 0001 0000) by performing a matrix operation:

$$[0\ 0\ 0\ 1\ 0\ 0\ 0\ 0\ 0\ 0\ 0\ 1\ 0\ 0\ 0\ 0] = [0\ 0\ 1\ 0]\times \begin{bmatrix} 1&0&1&0&1&0&1&0&1&0&1&0&1&0&1&0\\ 0&1&0&0&0&1&0&0&0&1&0&0&0&1&0&0\\ 0&0&0&1&0&0&0&0&0&0&0&1&0&0&0&0\\ 0&0&0&0&0&0&0&1&0&0&0&0&0&0&0&0 \end{bmatrix}$$

with an exemplary 4-by-16 transform matrix A given by:

$$A=\begin{bmatrix} 1&0&1&0&1&0&1&0&1&0&1&0&1&0&1&0\\ 0&1&0&0&0&1&0&0&0&1&0&0&0&1&0&0\\ 0&0&0&1&0&0&0&0&0&0&0&1&0&0&0&0\\ 0&0&0&0&0&0&0&1&0&0&0&0&0&0&0&0 \end{bmatrix}$$

and applying each digit of the middle driving data to corresponding subframes (i.e. at cycle=0, 1, . . . 15) respectively.

Figure 7A:
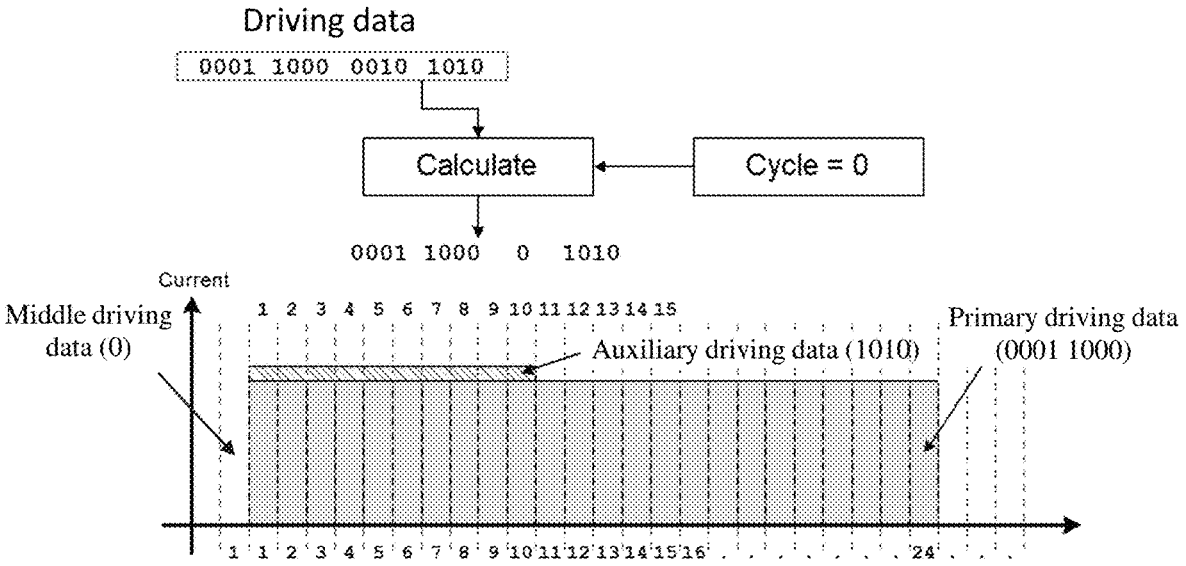
FIGS. 7A and 7B depict respectively the subframe driving waveforms and their applied driving data related to the mapping computation table of FIG. 6 at the subframes at cycle=0 and subframe at cycle=11.
Figure 7B:
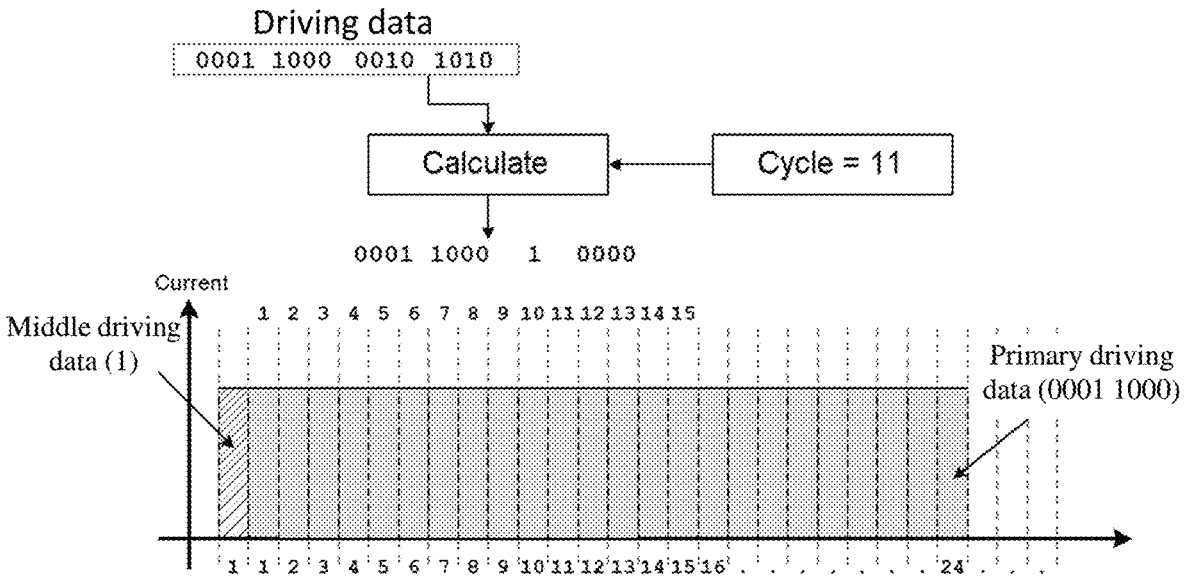

FIGS. 7A and 7B depicts respectively the subframe driving waveforms and their applied driving data at the subframes at cycle=0 and cycle=11 corresponding to the mapping computation table of FIG. 6.

In accordance with another embodiment of the present invention, a method based on pulse width modulation (PWM) with channel-to-channel compensation for driving a passive matrix display is provided. The method may comprise a subframe modulation process in which each frame of the display video is divided into T number of subframes. The PMW driving waveform at each subframe comprises a primary waveform, a middle waveform and an auxiliary waveform. Each pixel is then driven by T number of subframe driving waveforms within each frame at a subframe rate which is T times of the original frame rate. For a display based on an original PWM operated at a N-bit resolution, the subframe PWM in each subframe will then be generally operated at a N'-bit resolution, where N'=(N $\log_2$T).

The method may further comprise a compensation process in which an original driving signal for a pixel is compensated according to a compensation value to form a compensated driving data. The compensation process may comprise: converting the original driving signal for a pixel to a N-bit digital original data; converting the compensation value to a N-bit digital compensation data; multiplying the digital compensation data by T; combining the digital original data and the multiplied digital compensation data to form a N-bit compensated driving data. The compensation value for pixels at each scan data line may be determined in factory by testing the illuminance characteristics of the pixels at each scan data line. The determined compensation data may be stored in one-time programmable memory.

Figure 8:
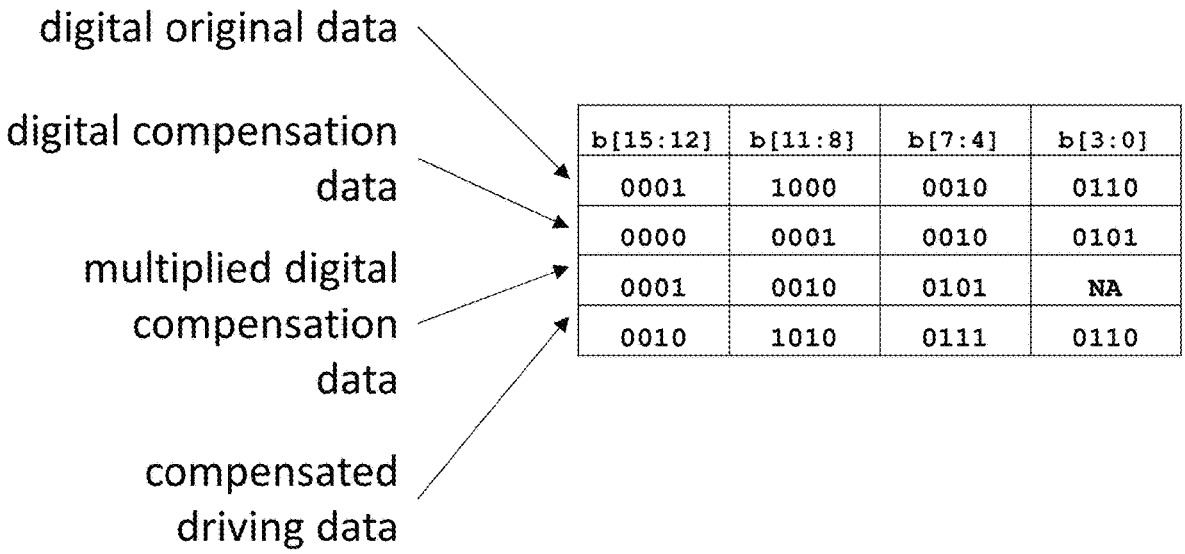
FIG. 8 depicts a compensation computation table for an exemplary compensation process in accordance with an embodiment of the present invention.

FIG. 8 depicts a compensation computation table for an exemplary compensation process in accordance with an embodiment of the present invention. In this exemplary compensation process, an original driving signal is converted to a 16-bit digital original data (0001 1000 0010 0110). A compensation value is converted to a 16-bit digital compensation data (0000 0001 0010 0101). The 16-bit digital compensation data is multiplied by 16 which is the number of subframes and combined with the 16-bit digital original data to form a 16-bit compensated driving data (0010 1010 0111 0110).

The method may further comprise a mapping process in which the N-bit compensated driving data are mapped into the T number of subframes to drive the pixel. The mapping of the N-bit compensated driving data into the T number of subframes comprises: extracting R number of the rightmost digits of the compensated driving data to form a R-bit auxiliary driving data and applying the auxiliary driving data into an auxiliary waveform of only one of the T number of subframes; extracting M number of middle digits of the compensated driving data, wherein M is given by M=$\log_2$T and the M number of middle digits are adjacent to the R number of rightmost digits, and transforming the M number of the middle digits into a T-bit middle driving data and applying each digit of the middle driving data to middle waveforms of corresponding subframe respectively; extracting L number of the leftmost digits of the compensated driving data to form a L-bit primary driving data, where L=N−M−R, and applying the primary driving data to primary waveforms of all of the T number of subframes.

Preferably, the T-bit middle driving data may be obtained by a matrix operation: x'=xA, where x is a 1-by-M matrix with its entries $x_{1i}$ being equal to the $i^{th}$ digit (i=1, 2, . . . M) of the M number of middle digits of the compensated driving data, A is a M-by-T transform matrix with its entries being binary digits, and x' is a 1-by-T matrix with its entries $x'_{1j}$ forming the $j^{th}$ digit of the T-bit middle driving data (j=1, 2, . . . , T).

The transform matrix A may comprise T−1 number of "1" digits. Each column of the transform matrix A may have at most one "1" digit and each row of the transform matrix A may have at least one "1" digits.

Optionally, the $k^{th}$ row of the transform matrix A may have N/($2^k$) number of "1" digits, wherein k=1, 2, . . . M.

For a subframe PWM driving arrangement where N=16, T=16 and R=4, the number M is given by M=$\log_2$T=$\log_2$(16)=4 and the number L is given by L=N−R−M=16−4−4=8. The compensated driving data is mapped to the 16 subframes by: extracting the eight leftmost digits of the compensated driving data to form a 8-bit primary driving data and applying the primary driving data to primary waveforms of all of the 16 subframes, extracting the four rightmost digits of the compensated driving data to form a 4-bit auxiliary driving data and applying the auxiliary driving data to an auxiliary waveform of only one of the 16 subframes, and transforming the four middle digits of the compensated driving data into a 16-bit middle driving data and applying each digit of the middle driving data to middle waveforms of corresponding subframes respectively. The transformation is by performing a matrix operation with a 4-by-16 transform matrix A given by:

$$A = \begin{bmatrix} 1 & 0 & 1 & 0 & 1 & 0 & 1 & 0 & 1 & 0 & 1 & 0 & 1 & 0 & 1 & 0 \\ 0 & 1 & 0 & 0 & 0 & 1 & 0 & 0 & 0 & 1 & 0 & 0 & 0 & 1 & 0 & 0 \\ 0 & 0 & 0 & 1 & 0 & 0 & 0 & 0 & 0 & 0 & 0 & 1 & 0 & 0 & 0 & 0 \\ 0 & 0 & 0 & 0 & 0 & 0 & 0 & 1 & 0 & 0 & 0 & 0 & 0 & 0 & 0 & 0 \end{bmatrix},$$

which has eight "1" in the first row, four "1" in the second row, two "1" in the third row and one "1" in the fourth row.

For a subframe PWM driving arrangement where N=16, T=8 and R=4, the number M is given by M=$\log_2$T=$\log_2$(8)=3 and the number L is given by L=N−R−M=16−4−3=9. The compensated driving data is mapped to the 8 subframes by: extracting the nine leftmost digits of the compensated driving data to form a 9-bit primary driving data and applying the primary driving data to primary waveforms all of the 8 subframes, extracting the four rightmost digits of the compensated driving data to form a 4-bit auxiliary driving data and applying the auxiliary driving data to an auxiliary waveform of only one of the 8 subframes, and transforming the three middle digits of the compensated driving data into a 8-bit middle driving data and applying each digit of the middle driving data to middle waveforms of corresponding subframes respectively. The transformation is by performing a matrix operation with a 3-by-8 transform matrix A given by:

$$A = \begin{bmatrix} 1 & 0 & 1 & 0 & 1 & 0 & 1 & 0 \\ 0 & 1 & 0 & 0 & 0 & 1 & 0 & 0 \\ 0 & 0 & 0 & 1 & 0 & 0 & 0 & 0 \end{bmatrix},$$

which has four "1" in the first row, two "1" in the second row and one "1" in the third row.

FIG. 9 shows a mapping computation table for an exemplary mapping process for a subframe PWM driving arrangement where N=16, T=16 and R=4. In the exemplary mapping process as shown in FIG. 9, a 16-bit compensated driving data (0010 1010 0111 0110) is mapped by: extracting the eight leftmost digits (i.e. b [15:8]) of the compensated driving data to form an 8-bit primary driving data (0010 1010) and applying the primary driving data to all of the subframes (i.e. at cycle=0, 1, . . . 15), extracting the four rightmost digits (i.e. b[3:0]) of the compensated driving data to form a 4-bit auxiliary driving data (0110) and applying the auxiliary driving data into the first frame (i.e. at cycle=0) only as an example, transforming the four middle digits (i.e. b[7:4]) of the compensated driving data into a 16-bit middle driving data (0101 0101 0101 0100) by performing a matrix operation:

$$[0\ 1\ 0\ 1\ 0\ 1\ 0\ 1\ 0\ 1\ 0\ 1\ 0\ 1\ 0\ 0] = [0\ 1\ 1\ 1] \times \begin{bmatrix} 1 & 0 & 1 & 0 & 1 & 0 & 1 & 0 & 1 & 0 & 1 & 0 & 1 & 0 & 1 & 0 \\ 0 & 1 & 0 & 0 & 0 & 1 & 0 & 0 & 0 & 1 & 0 & 0 & 0 & 1 & 0 & 0 \\ 0 & 0 & 0 & 1 & 0 & 0 & 0 & 0 & 0 & 0 & 0 & 1 & 0 & 0 & 0 & 0 \\ 0 & 0 & 0 & 0 & 0 & 0 & 0 & 1 & 0 & 0 & 0 & 0 & 0 & 0 & 0 & 0 \end{bmatrix}$$

with an exemplary 4-by-16 transform matrix A given by:

$$A = \begin{bmatrix} 1 & 0 & 1 & 0 & 1 & 0 & 1 & 0 & 1 & 0 & 1 & 0 & 1 & 0 & 1 & 0 \\ 0 & 1 & 0 & 0 & 0 & 1 & 0 & 0 & 0 & 1 & 0 & 0 & 0 & 1 & 0 & 0 \\ 0 & 0 & 0 & 1 & 0 & 0 & 0 & 0 & 0 & 0 & 0 & 1 & 0 & 0 & 0 & 0 \\ 0 & 0 & 0 & 0 & 0 & 0 & 0 & 1 & 0 & 0 & 0 & 0 & 0 & 0 & 0 & 0 \end{bmatrix};$$

and applying each digit of the middle driving data to corresponding subframes (i.e. at cycle=0, 1, . . . 15) respectively.

Figure 10A:
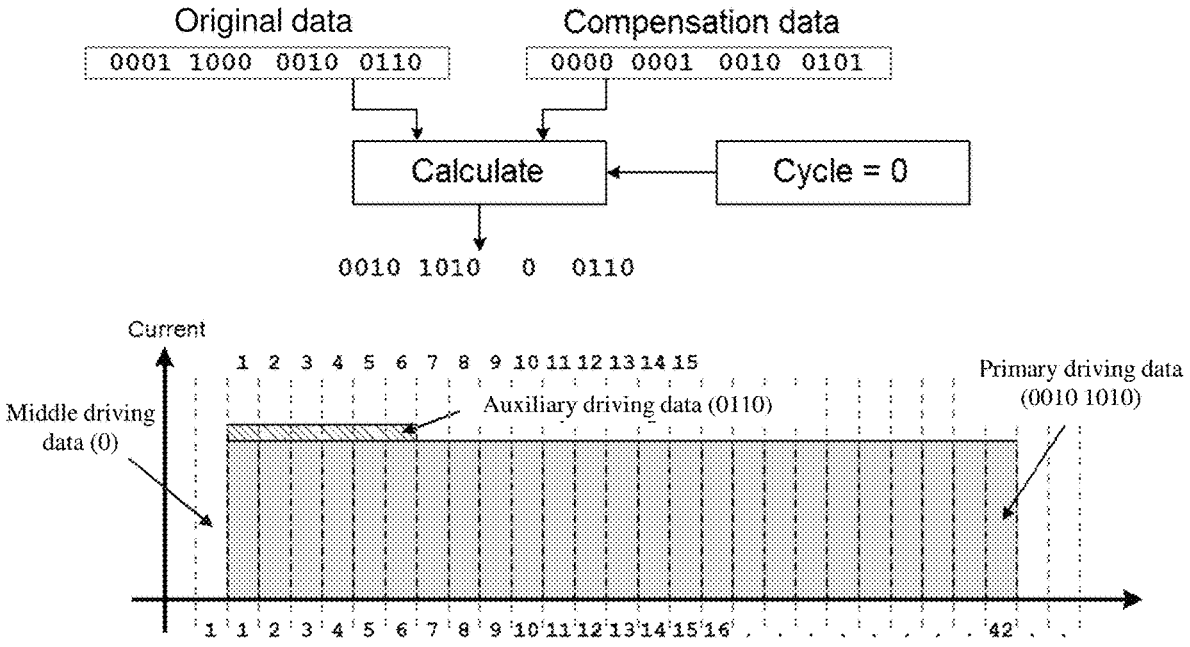
FIGS. 10A and 10B depict respectively the subframe driving waveforms and their applied driving data related to the mapping computation table of FIG. 9 at the subframes at cycle=0 and subframe at cycle=3.
Figure 10B:
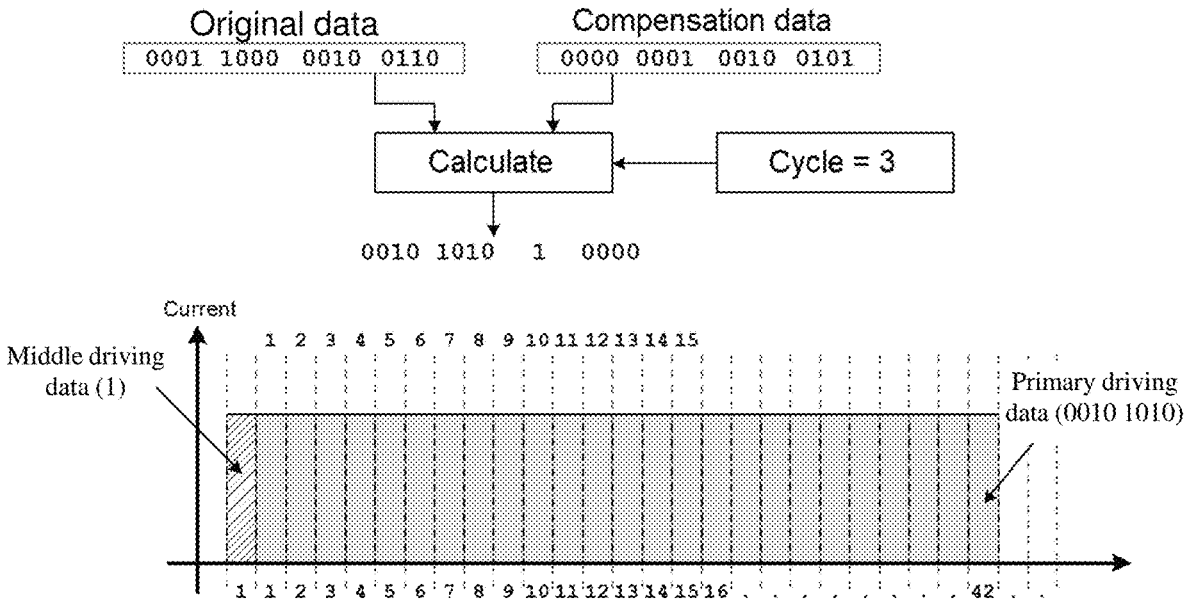

FIGS. 10A and 10B depicts respectively the subframe driving waveforms and their applied driving data at the subframes at cycle=0 and cycle=3 corresponding to the mapping computation table of FIG. 9.

Figure 11:
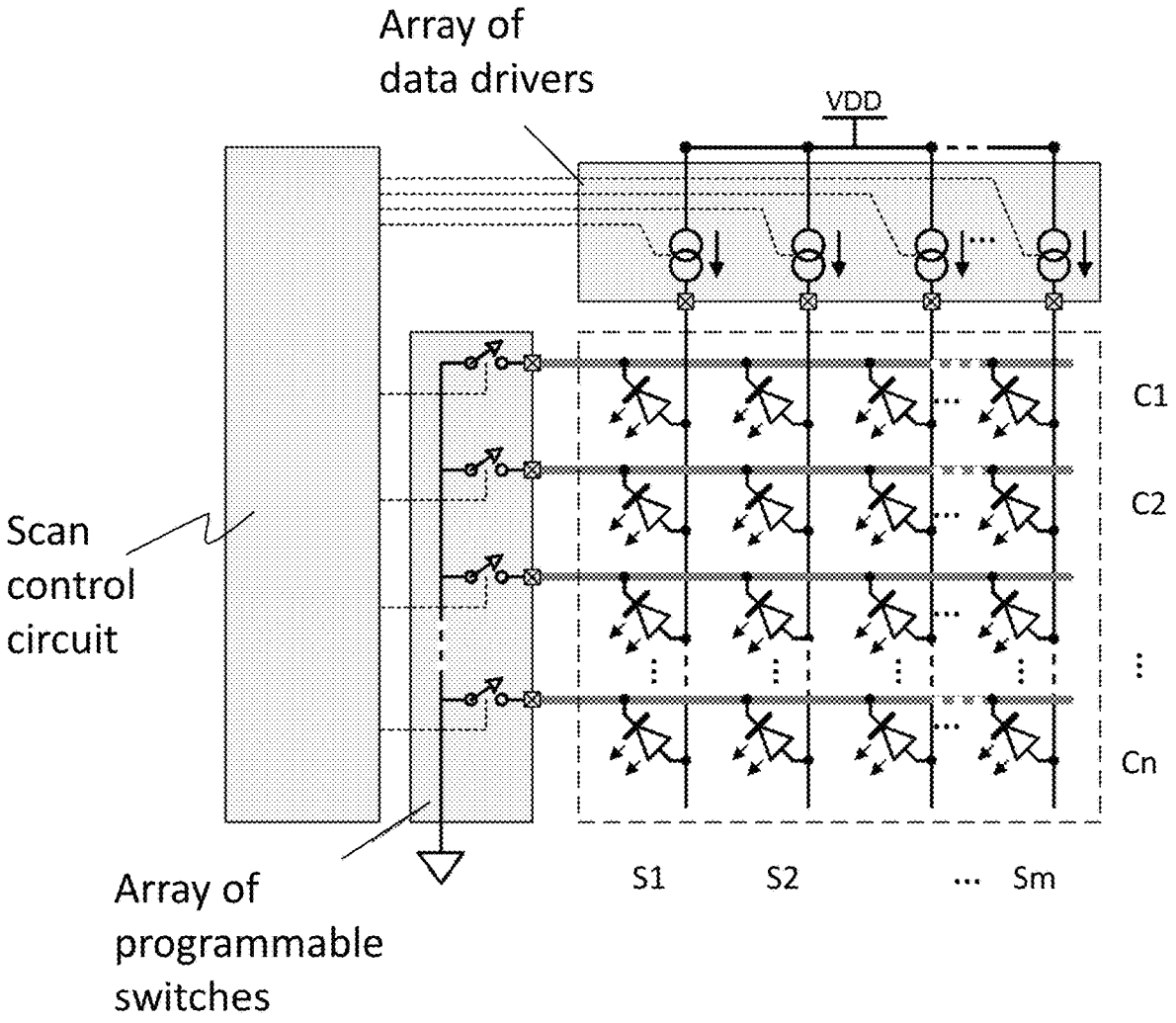
FIG. 11 depicts a block diagram for a passive matrix display panel according to an embodiment of the invention.

FIG. 11 illustrates a block diagram for a passive matrix display panel according to an embodiment of the invention. The passive matrix display panel may comprise a matrix of pixels. Each pixel may include one or more electroluminescent elements. Each row of electroluminescent elements is electrically connected to a scan signal line through a corresponding row of common electrodes (C1, C2 . . . to Cn, where n being total number of scan signal lines) and each column of electroluminescent elements is electrically connected to a data signal line through a corresponding column of source electrodes (S1, S2 . . . to Sm, where m being total number of data signal lines). The source electrodes may be configured to provide electric current to the electroluminescent elements while the common electrodes may be configured to collect electric current from the electroluminescent elements. The pixels of the display panel can be addressed and activated by passing current through selection of the source and common electrodes.

The passive matrix display panel may further comprise a scan control circuit for sequentially selecting a line of pixels to be updated or refreshed and an array of programmable switches being controlled by the scan control circuit. Each switch is connected to a scan signal line such that electroluminescent elements connected to the scan signal line is shorted a ground voltage GND when the switch is closed.

The passive matrix display panel may further comprise an array of data drivers, each connected to a data signal line to update or refresh a selected line of pixels by driving their corresponding electroluminescent elements.

Figure 12:
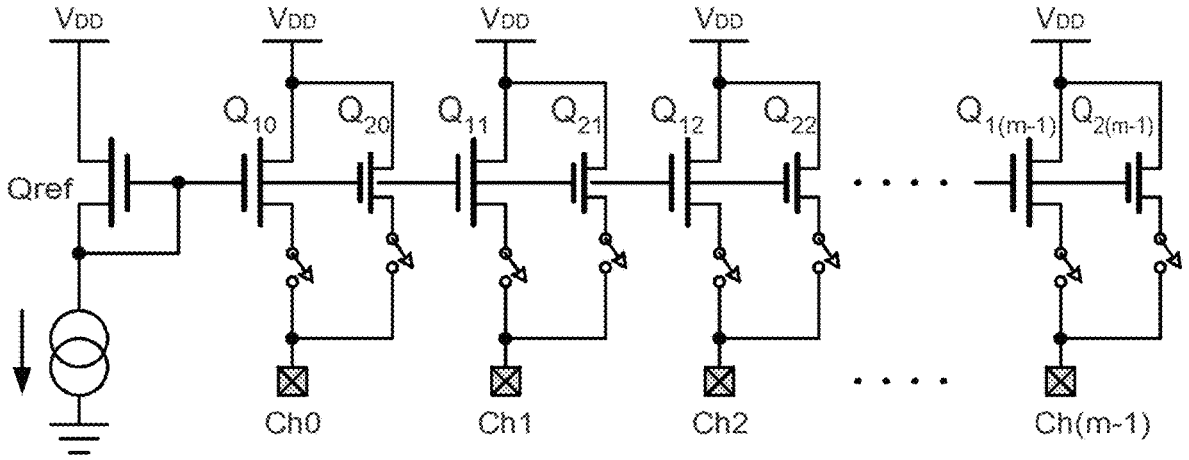
FIG. 12 depicts a data driver comprising a current mirror circuit for implementation of the subframe PWM and compensation according to an embodiment of the invention.

FIG. 12 depicts a data driver comprising a current mirror circuit for implementation of the subframe PWM and compensation according to an embodiment of the invention. The current mirror circuit may comprise an array of m current sources for driving electroluminescent elements at different data signal lines (or channels Ch0, Ch1 . . . Ch(m−1)) respectively, where m is total number of data signal lines in the display panel. The current mirror circuit may further have a reference transistor Qref to provide reference current to control the output current of the current sources. Each current source may comprise a first transistor ($Q_{10}$, $Q_{11}$, . . . , $Q_{1(m-1)}$) and a second transistor ($Q_{20}$, $Q_{21}$, . . . , $Q_{2(m-1)}$), both are matched with the reference transistor Qref such that the ratio of their output current amplitudes is $2^R$, where R is number of bits of the auxiliary driving data. Each first transistor may be configured to deliver a primary waveform applied with a primary driving data and/or a middle waveform applied with a middle driving data; and the second transistors may be configured to deliver an auxiliary waveform applied with an auxiliary driving data, so as to drive a corresponding electroluminescent element.

It should be apparent to practitioner skilled in the art that the foregoing examples of subframe modulation, compensation process, mapping process, and transform matrix are only for the purposes of illustration of working principle of the present invention. It is not intended to be exhaustive or to limit the invention to the precise forms disclosed.

The embodiments disclosed herein may be implemented using general purpose or specialized computing devices, computer processors, or electronic circuitries including but not limited to digital signal processors (DSP), application specific integrated circuits (ASIC), field programmable gate arrays (FPGA), and other programmable logic devices configured or programmed according to the teachings of the present disclosure. Computer instructions or software codes running in the general purpose or specialized computing devices, computer processors, or programmable logic devices can readily be prepared by practitioners skilled in the software or electronic art based on the teachings of the present disclosure.

In some embodiments, the present invention includes computer storage media having computer instructions or software codes stored therein which can be used to program computers or microprocessors to perform any of the processes of the present invention. The storage media can include, but are not limited to ROMs, RAMs, flash memory devices, or any type of media or devices suitable for storing instructions, codes, and/or data.

The foregoing description of the present invention has been provided for the purposes of illustration and description. It is not intended to be exhaustive or to limit the invention to the precise forms disclosed. Many modifications and variations will be apparent to the practitioner skilled in the art.

The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the following claims and their equivalence.

What is claimed is:

1. A method for driving a passive matrix display based on a pulse width modulation (PWM) operated at a N-bit resolution, comprising:

dividing each frame of a display video into T number of subframes, wherein the PWM driving waveform at each subframe comprises a primary waveform, a middle waveform and an auxiliary waveform;

converting an original driving signal for a pixel to a N-bit digital driving data; and mapping the original driving data into the T number of subframes, wherein the mapping comprises:

extracting R number of the rightmost digits of the digital driving data to form a R-bit auxiliary driving data and applying the auxiliary driving data into an auxiliary waveform of only one of the T number of subframes;

extracting M number of middle digits of the digital driving data, wherein M is given by $M=\log_2 T$ and the M number of middle digits are adjacent to the R number of rightmost digits, and transforming the M number of the middle digits into a T-bit middle driving data and applying each digit of the middle driving data to middle waveforms of corresponding subframes respectively; and extracting L number of the leftmost digits of the digital driving data to form a L-bit primary driving data, where L=N−M−R, and applying the primary driving data to primary waveforms of all of the T number of subframes.

2. The method of claim 1, wherein the T-bit middle driving date is obtained by a matrix operation:

$$x'=xA,$$

wherein x is a 1-by-M matrix with its entries xi' being equal to the $i^{th}$ digit (i=1, 2, . . . M) of the M number of the middle digits of the digital driving data, A is a M-by-T transform matrix with its entries being binary digits, and x' is a 1-by-T matrix with its entries $x'_{1j}$ forming the $j^{th}$ digit of the T-bit middle driving data (j=1, 2, . . . , T).

3. The method of claim 2, wherein the transform matrix A comprises T−1 number of "1" digits.

4. The method of claim 3, wherein the T−1 number of "1" digits of the transform matrix A are allocated such that: each column of the transform matrix A has at most one "1" digit; and each row of the transform matrix A has at least one "1" digits.

5. The method of claim 4, wherein the transform matrix A is configured to be allocated with $N/(2^k)$ number of "1" digits in its $k^{th}$ row, wherein k=1, 2, . . . M.

6. A method for driving a passive matrix display based on a pulse width modulation (PWM) operated at a N-bit resolution, comprising:

dividing each frame of a display video into T number of subframes, wherein the PWM driving waveform at each subframe comprises a primary waveform, a middle waveform and an auxiliary waveform;

compensating an original driving signal for a pixel according to a compensation value to from a compensated driving data, wherein the compensation comprises:

converting the original driving signal to a N-bit digital original data;

converting the compensation value to a N-bit digital compensation data;

multiplying the digital compensation data by T; and combining the digital original data and the multiplied digital compensation data to form a N-bit compensated driving data; and mapping the compensated driving data into the T number of subframes, wherein the mapping comprises:

extracting R number of the rightmost digits of the compensated driving data to form a R-bit auxiliary driving data and applying the auxiliary driving data to an auxiliary waveform of only one of the T number of subframes;

extracting M number of middle digits of the compensated driving data, wherein M is given by $M=\log_2 T$ and the M number of middle digits are adjacent to the R number of rightmost digits, and transforming the M number of the middle digits into a T-bit middle driving data and applying each digit of the middle driving data to middle waveforms of corresponding subframes respectively; and extracting L number of the leftmost digits of the compensated driving data to form a L-bit primary driving data, where L=N−M−R, and applying the primary driving data to primary waveforms of all of the T number of subframes.

7. The method of claim 6, wherein the T-bit middle driving date is obtained by a matrix operation:

$$x'=xA,$$

wherein x is a 1-by-M matrix with its entries xii being equal to the $i^{th}$ digit (i=1, 2, . . . M) of the M number of middle digits of the compensated driving data, A is a M-by-T transform matrix with its entries being binary digits, and x' is a 1-by-T matrix with its entries $x'_{1j}$ forming the $j^{th}$ digit of the T-bit middle driving data (j=1, 2, . . . , T).

8. The method of claim 7, wherein the transform matrix A comprises T−1 number of "1" digits.

9. The method of claim 8, wherein the T−1 number of "1" digits of the transform matrix A are allocated such that: each column of the transform matrix A has at most one "1" digit; and each row of the transform matrix A has at least one "1" digits.

10. The method of claim 9, wherein the transform matrix A is configured to be allocated with $N/(2^k)$ number of "1" digits in its $k^{th}$ row, wherein k=1, 2, . . . M.

11. A passive matrix display having a N-bit resolution, comprising a pulse width modulation (PWM) based display driver and configured to:

divide each frame of a display video into T number of subframes, wherein the PWM driving waveform at each subframe comprises a primary waveform, a middle waveform and an auxiliary waveform;

convert an original driving signal for a pixel to a N-bit digital driving data; and map the digital driving data into the T number of subframes, wherein the mapping comprises:

extracting R number of the rightmost digits of the digital driving data to form a R-bit auxiliary driving data and applying the auxiliary driving data into an auxiliary waveform of only one of the T number of subframes;

extracting M number of middle digits of the digital driving data, wherein M is given by $M=\log_2 T$ and the M number of middle digits are adjacent to the R number of rightmost digits, and transforming the M number of the middle digits into a T-bit middle driving data and applying each digit of the middle driving data to middle waveforms of corresponding subframes respectively; and extracting L number of the leftmost digits of the digital driving data to form a L-bit primary driving data, where L=N−M−R, and applying the primary driving data to primary waveforms of all of the T number of subframes.

12. The passive matrix display of claim 11, wherein the T-bit middle driving date is obtained by a matrix operation:

$$x'=xA,$$

wherein x is a 1-by-M matrix with its entries xii being equal to the $i^{th}$ digit (i=1, 2, . . . M) of the M number of middle digits of the digital driving data, A is a M-by-T transform matrix with its entries being binary digits, and x' is a 1-by-T matrix with its entries $x'_{1j}$ forming the $j^{th}$ digit of the T-bit middle driving data (j=1, 2, . . . , T).

13. The passive matrix display of claim 12, wherein the transform matrix A comprises T−1 number of "1" digits.

14. The passive matrix display of claim 13, wherein the T−1 number of "1" digits of the transform matrix A are allocated such that: each column of the transform matrix A has at most one "1" digit; and each row of the transform matrix A has at least one "1" digits.

15. The passive matrix display of claim 14, wherein the transform matrix A is configured to be allocated with $N/(2^k)$ number of "1" digits in its $k^{th}$ row, wherein k=1, 2, . . . M.

16. A passive matrix display having a N-bit resolution, comprising a pulse width modulation (PWM) based display driver and configured to:

divide each frame of a display video into T number of subframes, wherein the PWM driving waveform at each subframe comprises a primary waveform, a middle waveform and an auxiliary waveform;

compensate an original driving signal for a pixel according to a compensation value to form a compensated driving data, wherein the compensation comprises:

converting the original driving signal to a N-bit digital original data;

converting the compensation value to a N-bit digital compensation data;

multiplying the digital compensation data by T; and combining the digital original data and the multiplied digital compensation data to form a N-bit compensated driving data; and map the compensated driving data into the T number of subframes, wherein the mapping comprises:

extracting R number of the rightmost digits of the compensated driving data to form a R-bit auxiliary driving data and applying the auxiliary driving data into an auxiliary waveform of only one of the T number of subframes;

extracting M number of middle digits of the compensated driving data, wherein M is given by $M=\log_2 T$ and the M number of middle digits are adjacent to the R number of rightmost digits, and transforming the M number of the middle digits into a T-bit middle driving data and applying each digit of the middle driving data to middle waveforms of corresponding subframes respectively; and extracting L number of the leftmost digits of the compensated driving data to form a L-bit primary driving data, where L=N−M−R, and applying the primary driving data to primary waveforms of all of the T number of subframes.

17. The passive matrix display of claim 16, wherein the T-bit middle driving date is obtained by a matrix operation:

$$x'=xA,$$

wherein x is a 1-by-M matrix with its entries xi' being equal to the $i^{th}$ digit (i=1, 2, . . . M) of the M number of middle digits of the compensated driving data, A is a M-by-T transform matrix with its entries being binary digits, and x' is a 1-by-T matrix with its entries $x'_{1j}$ forming the $j^{th}$ digit of the T-bit middle driving data (j=1, 2, . . . , T).

18. The passive matrix display of claim 17, wherein the transform matrix A comprises T−1 number of "1" digits.

19. The passive matrix display of claim 18, wherein the T−1 number of "1" digits of the transform matrix A are allocated such that: each column of the transform matrix A has at most one "1" digit; and each row of the transform matrix A has at least one "1" digits.

20. The passive matrix display of claim 19, wherein the transform matrix A is configured to be allocated with $N/(2^k)$ number of "1" digits in its $k^{th}$ row, wherein k=1, 2, . . . M.

* * * * *